United States Patent [19]

Hollmann

[11] 3,949,495

[45] Apr. 13, 1976

[54] ANTI-SKIDDING DEVICE FOR SHOES

[76] Inventor: Arthur E. Hollmann, 5021 Frankfort, St. Louis, Mo. 63123

[22] Filed: Oct. 8, 1974

[21] Appl. No.: 513,042

[52] U.S. Cl. ..... 36/62
[51] Int. Cl.[2] ..... A43C 15/00
[58] Field of Search ..... 36/2.5 R, 7.6, 62

[56] References Cited

UNITED STATES PATENTS

| | | | |
|---|---|---|---|
| 1,194,191 | 8/1916 | Kirkwood | 36/62 |
| 2,170,138 | 8/1939 | Glenn | 36/62 |
| 2,211,291 | 8/1940 | Rupp | 36/62 |
| 3,359,659 | 12/1967 | Smolnik | 36/7.6 |

*Primary Examiner*—Patrick D. Lawson
*Attorney, Agent, or Firm*—Paul M. Denk

[57] ABSTRACT

An anti-skidding device for shoes including an elastic member that surrounds the vamp portion of a shoe and being urged upwardly thereon due to the inclined taper of its vamp, and a series of chain segments whose ends are attached to the elastic member and being arranged for draping under the shoe heel and sole to prevent slipping upon the ice during inclement weather.

6 Claims, 4 Drawing Figures

ANTI-SKIDDING DEVICE FOR SHOES

BACKGROUND OF THE INVENTION

This invention relates generally to a safety device, and more particularly pertains to an anti-skidding device that due to its inherent structure is snugly retained upon the shoe to facilitate walking upon slippery ground.

Numerous types of anti-slipping devices for shoes have been devised in the prior art, each intended to provide as the principal objective the preventing of one from slipping upon the ground as during icy conditions. Many of these devices are rather complex and of expensive construction, and require not only the use of a significant amount of materials in their construction, but also, in certain instances, require modification to the shoe itself, if not a complete redesign during its manufacture. For example, the U.S. Pat. to Simonson, No. 1,999,214, discloses the safety device for footwear wherein a series of chains are actually arranged within formed channels provided within the tread surfaces of the sole of the shown shoe or boot. In addition, the two U.S. Pat. to Dowling, Nos. 2,532,485, and 2,537,123, both disclose an anti-slip tread for a shoe wherein a series of studs are apparently built into the sole and heel of the shown footwear, and are useable for suspending a chain to facilitate both running as during participation in athletics, or walking over slippery ice-bound surfaces. As previously analyzed, all of the foregoing devices appear to require some actual redesign particularly to the sole and heel portions of the footwear.

Other types of anti-slipping devices, while not requiring any particular redesign to the footwear structure, are of a rather cumbersome formation which makes them both difficult and expensive to manufacture, and arduous to install. These types of devices are shown in the U.S. Pat. Nos. to Pulver, 2,450,768, Scace, 1,113,581, Young, 2,538,182, Cotter, 1,293,349, and Kniseley, 1,995,989.

The design of the present invention contemplates an anti-skidding device that may be easily applied to shoes with a minimum of effort, and just as easily removed, but at the same time insuring their contiguous and continuous retention upon the shoe even while walking at a fast gait, or while even on the run. The essence of the present invention is to provide a series of chain segment that will loop underneath contiguously with the sole and heel parts of the shoe, and which segments are directed laterally around the sides of the shoe and into proximity with the upper portion of its vamp where it is attached to an elastic member that is contintuously baised upwardly due to the inclined taper of the shoe vamp at this location. One other prior art patent gave some thought to an anti-slipping device for shoes that would provide adequate abrasiveness with an icy surface, as through the use of a series of chains, while at the same time recognizing the desire to being able to readily and quickly install or remove the device on or from the pair of shoes. This anti-slipping device is shown in the U.S. Pat. No. 1,362,225, to Carlslund, wherein is shown the series of chains that connect with an upper side chain that clamps into engagement with the upper side only of the shoe sole, which side chain is resiliently connected by means of a pair of coil springs to a heel encircling member that secures the device to its shoe. The desirable features of this prior anti-slipping device can readily be seen, in the provision of an abrasive contact with a slippery surface, in addition to a device that can be quickly inserted or removed from the shoe. But, one drawback of this prior device is that it utilizes only the narrow thickness of the sole for retaining the device to the shoe, which can easily lead to its frequent dislodgement or even loss of the device. This deficiency would certainly exist even more so when the device is worn upon older and more worn shoes, particularly where the sole edges have been significantly diminished due to constant wear.

In view of the teachings of the aforesaid prior art, it is the principal object of the present invention to provide an anti-skidding device for use on shoes wherein an elastic means is provided for securing the abrading producing chain segments to the upper vamp portion of the shoe thereby insuring the snug retention of the device without the slightest chance of its dislodgement.

Another object of this invention is to provide an anti-skidding device that utilizes the shape of the shoe construction itself for enhancing its retention during usage.

A further object of this invention is to provide an anti-skidding device for use upon footwear, which device is adjustable to allow its accommodating a wide variety or range of shoe sizes.

An additional object of this invention is to provide an anti-skidding device that is self-adjustable through its inherent elasticity while being stretched during its installation upon a shoe.

Yet another object of this invention is to provide an anti-skidding device that is pocket size, and which can be quickly and easily applied or removed at the whim of its wearer.

Still another object of this invention is to provide an anti-skidding device for shoes which is relatively simple in construction, easily manufactured, and of inexpensive cost.

Many other objects will become more apparent to those skilled in the art upon reviewing the summary of this invention, and analyzing the description of the preferred embodiment in view of its drawings.

SUMMARY OF THE INVENTION

This invention contemplates an anti-skidding device of relatively few parts, which can be easily inserted onto the shoe in a moments notice, and yet be quickly removed and compactly encased for carrying in the pocket when desired. These features are readily of benefit to delivery men, such as mailmen or the like, who are frequent in their movement between the indoors and outdoors as during the working day, and thereby require means to facilitate their working during inclement weather, particularly one presenting icy conditions.

The present invention contemplates an elastic means, being somewhat oval in shape so as to conform to the contours of the upper portion of the shoe, particularly the vamp portion, and which has dimensions less than the overall peripheral dimensions of the shoe sole, but which can be easily expanded to provide for its slipping over the sole and into contiguity with the upper shoe vamp. The elastic means comprises an elastic member formed preferably of plurality of rubber strands encased within an outer expandable covering, with the ends of said member being linked together to form the closed oval shape when installed. A series of chain means, such as segments of link chains, are connected at their ends to the approximate sides of the elastic member, with preferably one chain segment provided for draping under the heel of the shoe, as when installed, with one or more similiar type segments being connected to the apparent side portions of the oval elastic member and for also extending under the sole of the shoe approximate the ball, or frontal metatarsol, portion of the foot. Each chain segment has significant length to extend the transverse distance across the underside of the sole of the shoe, with additional sufficient linkage to provide for its ends extension up the sides of the shoe for connection with the elastic member, and in the vicinity of the upper vamp portion of the shoe. In addition, while the connectors are reasonably snug in their engagement with the elastic member, it is desirable that the connectors be easily shifted by hand along the length of the elastic member to provide for adjustment in the location of the chain segments with respect to the shoe upper upon which the device is fitted, particularly when the device may be utilized by a variety of people each exhibiting a differing shoe size. Or, so that the device can be universal in size to accommodate the shoe of almost any purchaser.

The essence of the invention is to provide a continuous elastic member that is slightly less in dimension than the peripheral dimension surrounding the upper vamp portion of the shoe, so that the device, when in place, will have its elastic member continuously urged upwardly along the incline taper of the vamp portion of the upper shoe, thereby continuously stretching the chain members to insure their snug embracement with the under side of the shoe sole and heel. And, depending upon the degree of traction desired with respect to the icy surface upon which the device is used, a chain segment may be formed from a series of links which may have either roughened edges, or smooth edges, as desired. Obviously, the link type chain having the more roughened or sharp edges, while being more effective in preventing slippage, also has a tendency to cut into the lower surface of the shoe components, whereas a smooth edged link chain will produce a contrary result.

DESCRIPTION OF THE PREFERRED EMBODIMENT

Figure 1:
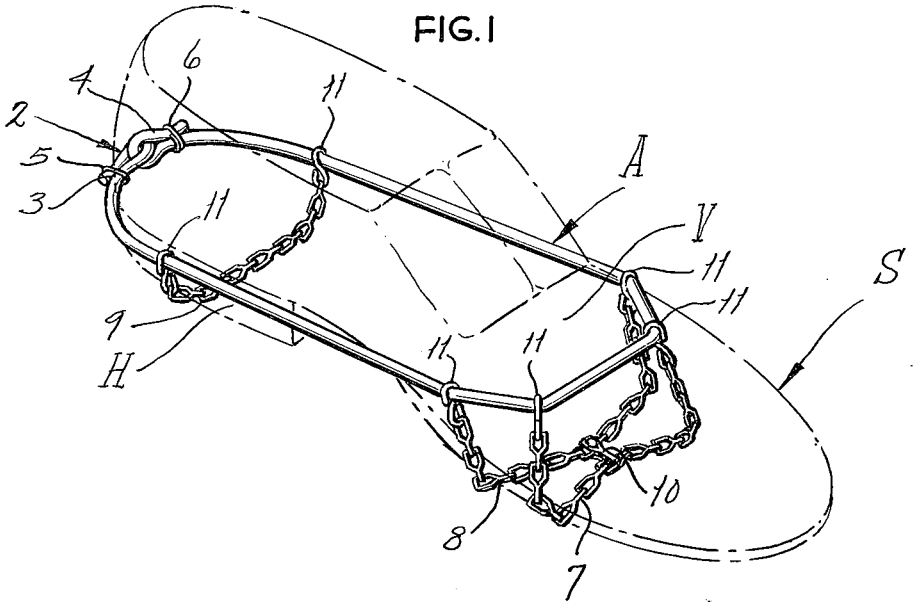
Figure 2:
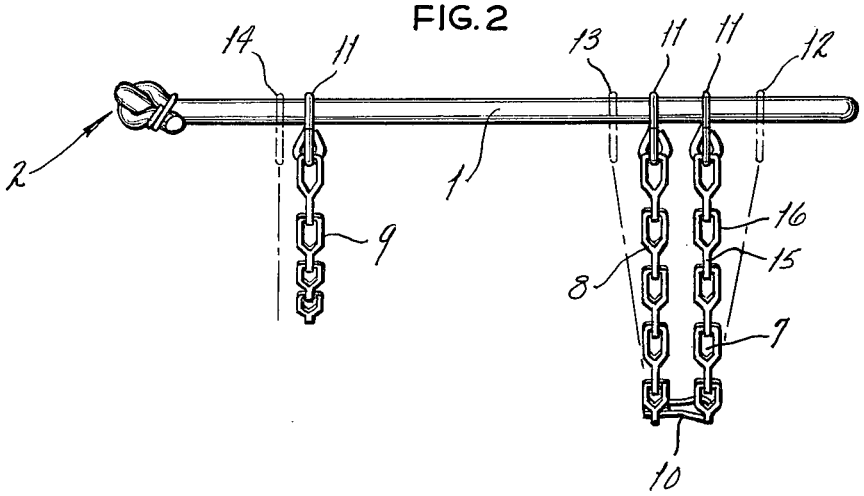
Figure 3:
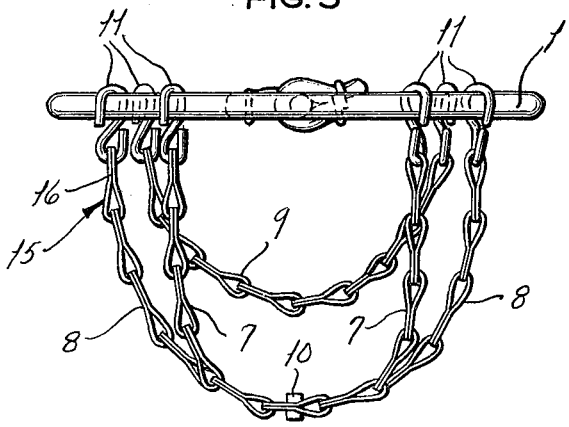

In the drawings, FIG. 1 provides an isometric view of the anti-skid device of this invention as applied to a shoe;

FIG. 2 provides a side view of the invention before its application to a shoe;

FIG. 3 provides a front view of the invention shown in FIG. 2; and

Figure 4:
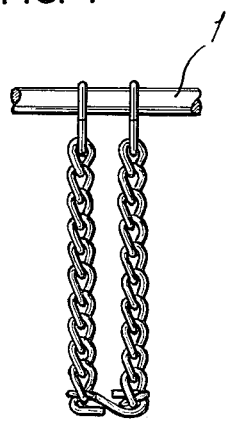

FIG. 4 provides a partial view of modified front chain segments for this invention.

DESCRIPTION OF THE PREFERRED EMBODIMENT

In referring to FIG. 1 of the drawing, there shown is the anti-skidding device A of this invention as applied upon a shoe S. The device is disclosed as comprising an elastic means, one which is of a size to provide for its snug embracement upon the vamp portion V of the upper shoe. The elastic means 1 is formed as a length of elastic member the ends of which are secured together as at 2, to provide a closed loop that conforms to the oval shape to the upper vamp portion of the shoe, as shown. The secured ends 3 and 4 of the elastic member may be secured together in any conventional manner, but in the method shown simply provides for the ends being looped together and fastened by means of the clamps 5 and 6 to form the continuous elastic means 1.

The elastic member 1 may comprise any form of stretchable material, but preferably is formed as a series of rubber strands that are enclosed in an outer cloth or plastic covering that is reasonably stretchable coextensive with said strands so as to compensate for the application or removal of the device onto or from the shoe, as shown.

It can also be readily observed from viewing this FIG. 1 that the basic principle of this invention, as previously summarized, is that the disposition of the elastic member 1 when finally installed is to gradually rise upwardly upon the shoe, and in this manner, provides for snug retention of the entire device to the shoe of the wearer, with little or no chance of its dislodgement during usage. The limits to the upward movement of the elastic member is set by the arrangement of a series of chain means, such as the segments 7 and 8, disposed approximate the forward portion of the member 1, in addition to their being located transversely across the underside of the ball portion of the shoe sole. In addition, a chain segment 9 is provided spanning transversely across the underside of the heel portion H of the shoe, and together, these chain segments 7 through 9 furnish a definitive height to which the elastic member 1 will rise upon the shoe. Likewise, due to the inherent elasticity of the member 1, the constant shrinking stress acting upon the elastic member 1 giving it a tendency to rise upon the vamp of the shoe insures a snug embracement of the chain segments 7 through 9 with the underside of the shoe sole and heel, thereby furnishing snugness in fitting and generally in the disposition of the anti-skidding device of this invention during application. To insure adequate traction of the chain segments 7 and 8 proximate the under portion of the shoe, and under the ball of the foot that bear the brunt of the weight during walking movement, a link 10 is designed for attaching the chain segments 7 and 8 together proximate this frequency stressed and applied location of the shoe.

By viewing FIGS. 2 and 3, this invention is shown in its noninstalled position depicting how the chain segments 7 through 9 and the link 10 suspend from the elastic member 1 as when not in use. Likewise, and as can easily be seen, since the chain segments are formed by individual chain links, and they in turn are secured to the elastic and easily collapsible member 1, the entire device can be compactly squeezed into a relatively small size for easy storage, such as even in a pocket of the user. As can also be seen from these figures, a series of connectors, as in 11, are provided for attaching each chain segment end to the elastic member 1. Preferably, although it is not essential, the connectors 11 snugly secure the chain segments to the member 1, and through the exertion of a minor force, they can be shifted along its length to provide for a relocation and a redisposing of the various chain segments with respect to the elastic member 1. Hence, the invention can be promptly adjusted so as to accommodate various sized shoes to which it may be installed.

By way of illustration, the adjustable feature of the chain segments of the invention is also shown in FIG. 2, whereas the connectors 11 securing the front chain segments 7 may be shifted forwardly, to a position where it is shown located at 12, while the connectors 11 securing the chain segment 8 may likewise be shifted in either direction, as for example, rearwardly as shown at 13, to provide adjustment to the location of these chain segments with respect to the frontal portion of the shoe and its concomitant sole. Where the shoe to which the invention may be installed is of an even larger size, then both of these connectors 11 associated with the chain segments 7 and 8 may be shifted forwardly to provide for a rearrangement in the location of the downward parts of said chain segments, and their connecting link 10, as to the frontal portion of the elongated shoe so that these components will rest proximate the middle of the ball portion of the sole and the contiguous surface. In addition to the adjustments that may be made to the frontal chain segments 7 and 8, as just analyzed, the back chain segments 9 may likewise be adjusted in size and location as through a shifting of its connector 11 to the position as shown at 14, where such an adjustment provides for the precise positioning of this chain segment under the midpoint of the shoe heel, and where it will attain its most effectivness during usage.

The type of link chain forming the chain segments 7 through 9, as shown in FIGS. 1 through 3 of the drawing, is of the style of change that is formed having rather flattened like sides, as at 15, with integral sharply pointed side edges, as at 16. This type of link chain is generally formed as a stamping, which thereby affords the more projecting and incisive edges as shown. Such chain segments are desirable from the standpoint of providing greater traction and etching to the icy surfaces upon which they are used, but in addition, they also have a tendency to cause a more rapid deterioration by means of a cutting of the undersurface of both the appended heel and sole portions of the shoe. Hence, to help alleviate this problem, the connectors 11 are designed so that in their securement to the elastic member 1, they have a tendency to dispose the substantially flatten-like sides 15 to the contiguous surfaces, including the underside of the shoe sole, so that the least amount of cutting will occur. As an alternative, the lengths of the chain segments 7 through 9 may be formed of the more rounded type of metal link that are constructed from short lengths of rod so that little or no roughened or sharp edges are present. This style of link chain is shown in FIG. 4, and while it does sacrifice some of the abrasiveness that can be acquired from the type of link chain shown, for example, in FIG. 2, it does still act effectively in preventing skidding of the wearer while walking or moving upon slippery surfaces.

The description of the preferred embodiment shown herein is set forth by way of illustration, and is not intended to give a restrictive interpretation to the following claims. On the contrary, the described embodiment is meant to be illustrative of the principle of this invention, and any changes, variations, modifications to this invention, occuring to those skilled in the art are intended to fall within the purview of the claims as hereinafter set forth.

Having thus described the invention what is claimed and desired to be secured by Letters Patent is:

1. In an anti-skidding device for use in cooperating with the shoe vamp and its sole and heel part for preventing the user from slipping on the ground during inclement weather, comprising, chain means providing for embracing the underside of the sole and useful for abrasively contacting the ground, said chain means comprising a pair of chain segments, an elastic means encircling the upper shoe vamp and being biased upwardly due to the inclined taper of said shoe vamp, the ends of each chain segment being attached to the elastic means at a position approximately laterally of the shoe vamp, a link attaching the pair of chain segments together at a location proximate the underside of the shoe sole, another chain segment attaching to the elastic means approximately laterally of the upper shoe and for embracing the underside of the shoe heel, and the upward bias of said elastic means upon said shoe vamp effecting a constant draw of the chain segments to sustain their contiguous embracement against the underside of the shoe.

2. The invention of claim 1 wherein said chain segments are formed of a series of connecting chain links, each link being of the type having substantially flattened like sides with integral edges, and connectors attaching each end of a chain segment to the elastic means, said connectors being adjustable upon said elastic means to provide for rearrangement of the chain segments to compensate for differing shoe sizes.

3. The invention of claim 2 wherein the connectors attaching the chain segments to the elastic means orients the chain links to provide for the arrangement of one of their flatten like sides in contiguity with the surface of the shoe sole and heel.

4. The invention of claim 3 wherein said elastic means comprises a length of a series of rubber strands, a cloth covering surrounding said strands and capable of stretching therewith, and the ends of said cloth covered strands being secured together to form a continuous loop for surrounding the upper shoe after installation of the device.

5. In an anti-skidding device for use in cooperating with the shoe vamp and its sole and heel parts for preventing the user from slipping on the ground during inclement weather, comprising, chain means provided for embracing the underside of the sole and useful for abrasively contacting the ground, second chain means provided for embracing the underside of the heel part and useful for abrasively contacting the ground, an elastic means encircling the upper shoe vamp and being biased upwardly due to the inclined taper of the said shoe vamp, the ends of said chain means and second chain means being attached to said elastic means approximately laterally of the shoe vamp, and the upward bias of said elastic means upon said shoe vamp effecting a constant draw of the said chain means and second chain means to sustain their contiguous embracement against the underside of the shoe.

6. In an anti-skidding device for use in cooperating with the shoe vamp and its heel part for preventing the user from slipping on the ground during inclement weather, comprising chain means provided for embracing the underside of the heel and useful for abrasively contacting the ground, an elastic means encircling the upper shoe vamp and being biased upwardly due to the inclined taper of the said shoe vamp, the ends of said chain means being attached to said elastic means approximately laterally of the shoe vamp, and the upward bias of said elastic means upon said shoe vamp effecting a constant draw of a chain means to sustain its contiguous embracement against the underside of the shoe.

* * * * *